US008616138B1

(12) United States Patent
Fu

(10) Patent No.: US 8,616,138 B1
(45) Date of Patent: Dec. 31, 2013

(54) SHELVING SYSTEM

(71) Applicant: Kuang-Huan Fu, Su'ao Township, Yilan County (TW)

(72) Inventor: Kuang-Huan Fu, Su'ao Township, Yilan County (TW)

( * ) Notice: Subject to any disclaimer, the term of this patent is extended or adjusted under 35 U.S.C. 154(b) by 0 days.

(21) Appl. No.: 13/625,845

(22) Filed: Sep. 24, 2012

(51) Int. Cl.
*A47B 9/08* (2006.01)

(52) U.S. Cl.
USPC ..... 108/147.13; 211/187

(58) Field of Classification Search
USPC ..... 211/103, 175, 181.1, 182, 186, 187, 211/189, 190, 191, 192, 205, 207, 208; 108/106–110, 147.12, 147.13, 147.14, 108/147.15, 147.16, 147.17, 152; 248/243–245, 250
See application file for complete search history.

(56) References Cited

U.S. PATENT DOCUMENTS

| | | | | | |
|---|---|---|---|---|---|
| 911,567 | A * | 2/1909 | Berkowitz | 108/106 |
| 1,373,781 | A * | 4/1921 | Wagner | 108/109 |
| 1,984,473 | A * | 12/1934 | Gibson et al. | 108/152 |
| 2,150,795 | A * | 3/1939 | Beckwith | 108/152 |
| 3,273,720 | A * | 9/1966 | Seiz | 211/192 |
| 3,724,678 | A * | 4/1973 | Challier | 211/191 |
| 3,851,601 | A * | 12/1974 | Davis | 108/158.11 |
| 3,881,829 | A * | 5/1975 | James | 403/27 |
| 3,898,939 | A * | 8/1975 | Grachten | 108/109 |
| 4,273,463 | A * | 6/1981 | Dobersch | 403/246 |
| 4,453,472 | A * | 6/1984 | Ward | 108/107 |
| 4,582,001 | A * | 4/1986 | Leikarts | 108/106 |
| 4,592,286 | A * | 6/1986 | Trubiano | 108/108 |
| 4,852,501 | A * | 8/1989 | Olson et al. | 108/107 |
| 4,892,044 | A * | 1/1990 | Welsch | 108/154 |
| 5,174,200 | A * | 12/1992 | Jeandel et al. | 108/187 |
| 5,695,081 | A * | 12/1997 | Alkalay | 211/187 |
| 6,044,988 | A * | 4/2000 | Yang | 211/187 |
| 6,230,910 | B1 * | 5/2001 | Olsson et al. | 211/192 |
| 6,302,284 | B1 * | 10/2001 | Zonshin | 211/187 |
| 8,042,477 | B2 * | 10/2011 | Lee | 108/147.12 |
| 8,074,583 | B2 * | 12/2011 | Lee | 108/147.13 |
| 8,118,181 | B2 * | 2/2012 | Shinozaki | 211/187 |
| 2002/0027116 | A1 * | 3/2002 | Herzog et al. | 211/192 |
| 2006/0202091 | A1 * | 9/2006 | Oddsen et al. | 248/122.1 |
| 2009/0184076 | A1 * | 7/2009 | Lee | 211/103 |
| 2010/0155352 | A1 * | 6/2010 | Hsieh | 211/134 |

* cited by examiner

*Primary Examiner* — Joshua Rodden
(74) *Attorney, Agent, or Firm* — Leong C. Lei

(57) ABSTRACT

A shelving system includes stand units, mounting connectors and supporting panels. The stand unit includes vertical portions and a horizontal portion. The vertical portion includes securement holes spaced apart from each other. Each mounting connector includes a main body having a through hole including an elastic securement hook, and the main body each includes a protruding block having parallel positioning holes. Two sides of each supporting panel include locking pins. Each mounting connector is mounted onto the vertical portions of the stand units by securing the securement hook into one of the securement holes of the vertical portions to allow the insertion of the locking pins of the supporting panels into the positioning holes to form directionally extended combinations of supporting panels such that the shelving system is configurable to be of different sizes and levels for storage and can be assembled and disassembled with ease.

7 Claims, 7 Drawing Sheets

SHELVING SYSTEM

TECHNICAL FIELD OF THE INVENTION

The present invention is related to a shelving system, and in particular, to a shelving system configurable to be different sizes and levels for storage and to be a novel structure that is convenient to assemble and disassemble.

DESCRIPTION OF THE PRIOR ART

Common shelves or shelving systems are structures designed with a certain size and level for storage. Despite being able to be assembled and disassembled, users are usually forced to purchase additional identical or non-identical individual shelf units when they want to extend it to a desired storage capacity. The consequences are extra costs and inconvenience use for common users. Knowing the drawbacks of current shelving systems, with years of R&D, the inventor provides this improved shelving system that is configurable in different sizes and levels and is a novel structure to easily assemble and disassemble.

SUMMARY OF THE INVENTION

A primary objective of the present invention is to provide a practical storage shelving system that can be configured efficiently into different sizes and levels.

The aforementioned shelving system comprises a plurality of, or at least one of, stand units, mounting connectors and supporting panels; wherein said stand unit comprises two vertical portions and a horizontal portion connected to said vertical portions. Said vertical portion comprises a plurality of securement holes spaced apart from each other. Said mounting connector comprises a main body having a through hole; wherein said through hole comprises an elastic securement hook at an internal thereof, and said main body comprises a horizontally extended protruding block having two positioning holes arranged parallel to each other. Two sides of the supporting panel comprise locking pins. The mounting connector penetrates through and mounted onto said vertical portions of said at least one stand unit by securing said securement hook into the securement hole of the vertical portions of the stand unit to allow said locking pins of the supporting panel to be inserted into the positioning holes such that assembly and disassembly of the shelving system of the present invention are facilitated and such that said shelving system of the present invention is configurable to be of different sizes and levels for storage.

In accordance with the aforementioned shelving system of the present invention, wherein said securement hook of said mounting connector comprises a slat formed between walls of said through hole and said positioning holes cut into two vertically sectioned slots and a protrusion with a predetermined height provided on an upper edge of said slat in order to form the elastic securement hook.

DETAILED DESCRIPTION OF THE PREFERRED EMBODIMENTS

Figure 1:
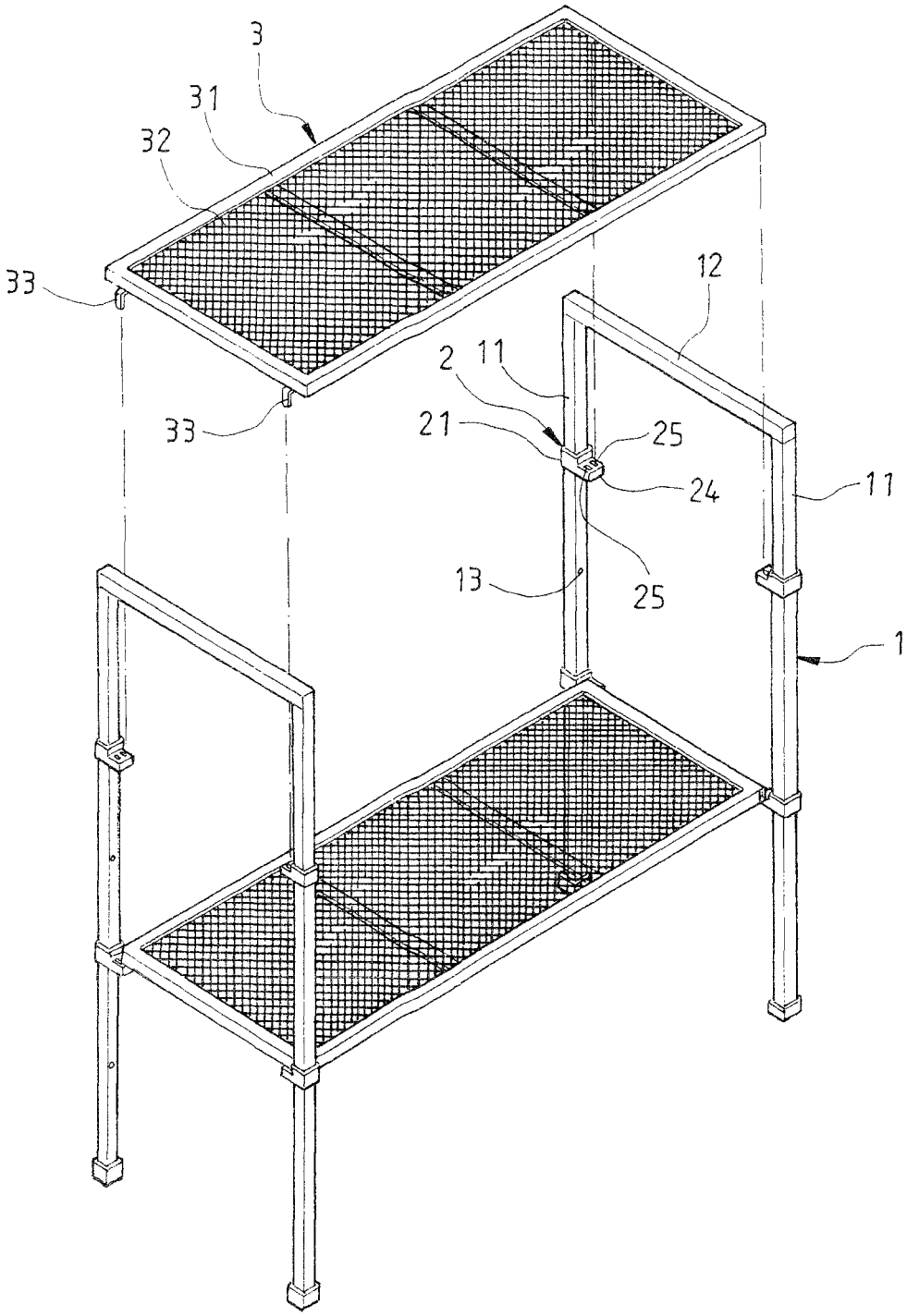
FIG. 1 is a perspective view of a first embodiment of the shelving system of the present invention.
Figure 2:
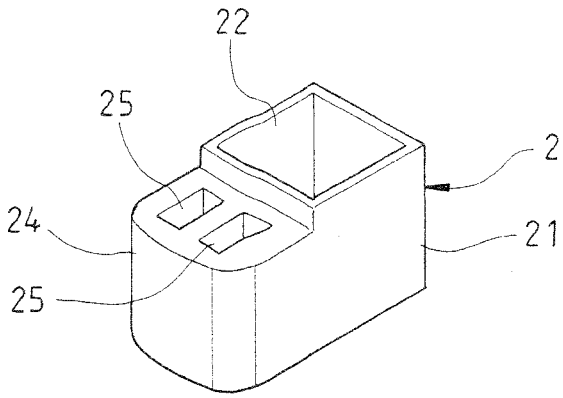
FIG. 2 is a perspective view of the mounting connector of the shelving system of the present invention.
Figure 3:
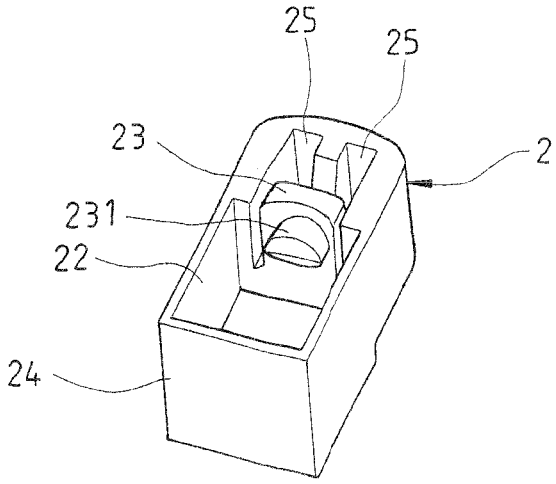
FIG. 3 is another perspective view of the mounting connector of the shelving system of the present invention.
Figure 4:
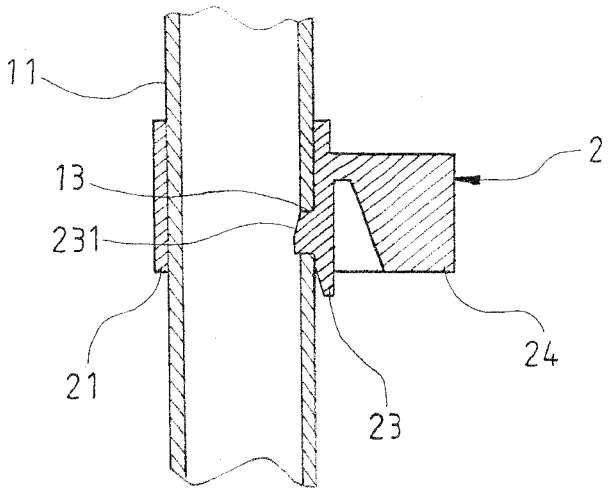
FIG. 4 is a cross sectional view of an assembly of the shelving system of the present invention.

FIG. 1 shows a perspective view of the shelving system of the present invention; FIGS. 2 and 3 are perspective views of the mounting connector of the shelving system of the present invention; FIG. 4 shows a cross sectional view of the stand unit of the shelving system of the present invention. As shown in these figures, the shelving system of the present invention comprises a plurality of, or at least one, stand units 1, mounting connectors 2 and supporting panels 3; wherein the at least one stand unit 1 comprises two vertical portions 11 and a horizontal portion 12 connected to said vertical portions 11. The vertical portions 11 comprise a plurality of securement holes 13 spaced apart from each other.

The at least one mounting connector 2 comprises a main body 21, configured to be of a rectangular shape in a first embodiment of the present invention, having a through hole 22. The through hole 22 comprises an elastic securement hook 23 at an internal thereof, and the main body 21 comprises a horizontally extended protruding block 24 having positioning holes 25 arranged parallel to each other. The protruding block 24 comprising a hollow portion formed therein, and said elastic securement hook 23 is arranged between said through hole 22 and said hollow portion in such a way that the elastic securement hook 23 is deflectable into the hollow portion to move out of said through hole 22. In the first embodiment of the present invention, the positioning holes 25 are rectangular-shaped holes; however, it can be understood that they can also be of circular-shaped holes. In addition, the securement hook 23 comprises a slat formed between walls of the through hole 22 and the positioning holes 25 and a protrusion 231 with a predetermined height provided on an upper edge of said slat with the protrusion 231 configured to be tilted at an angle in order to form the elastic securement hook 23. In the first embodiment of the present invention, the height of the securement hook 23 is greater than the one of the main body 21.

The at least one supporting panel 3 comprises a frame body 31 and a mesh member 32 such that the locking pins 33 are provided on the two sides of said frame body 31 and wherein the locking pins 33 are of an L shape.

According to the aforementioned structural configuration of the shelving system of the present invention, the at least one mounting connector 2 penetrates through the vertical portions 11 of the at least one stand unit 1 and is mounted thereon. As the mounting connector 2 is slidable mounted onto the vertical portions 11 and since the protrusion 231 is tilted at a predetermined angle with the securement hook 23 configured to exhibit an elasticity, the securement hook 23 is subject to pressing forces due to the vertical portions, which is further locked and secured by securing the protrusion 231 of the securement hook 23 into the securement hole 13 of the vertical portions 11 such that the plurality of mounting connectors are disposed on the two vertical portions 11 and such that the supporting panels 3 can be arranged in combination to extend in the vertical direction by inserting the locking pins 33 of the at least one supporting panel 3 into said positioning holes 25. To disassemble the shelving system for non-operational uses and since the height of the securement hook 23 is configured to be greater than the one of the main body 21, the user can exert an external force with any tool on the securement hook 23 toward the main body 21 in order to disengage the securement hook 23 of the main body 21 from the securement hole 13 of the vertical portions. Therefore, with the improved structural configurations of the shelving system of the present invention, the assembly and disassembly of said shelving system can be facilitated and the shelving system is configurable to be of different sizes and levels for storage, which in turn would too increase the practical usages and values of the shelving system.

Figure 5:
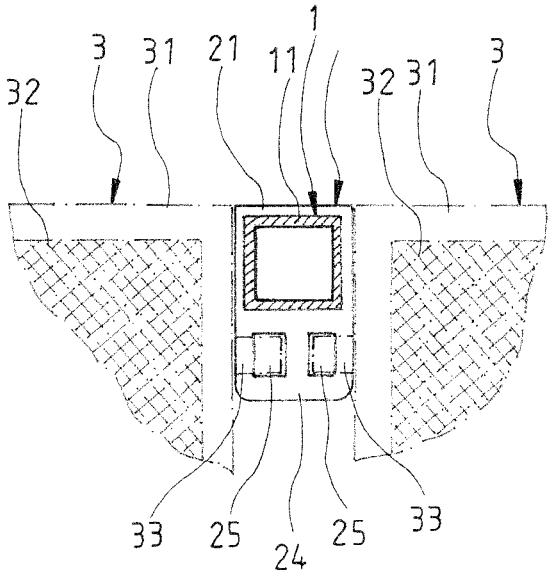
FIG. 5 is an illustration showing an embodiment assembled to be a horizontally extended combination of the shelving system of the present invention.
Figure 6:
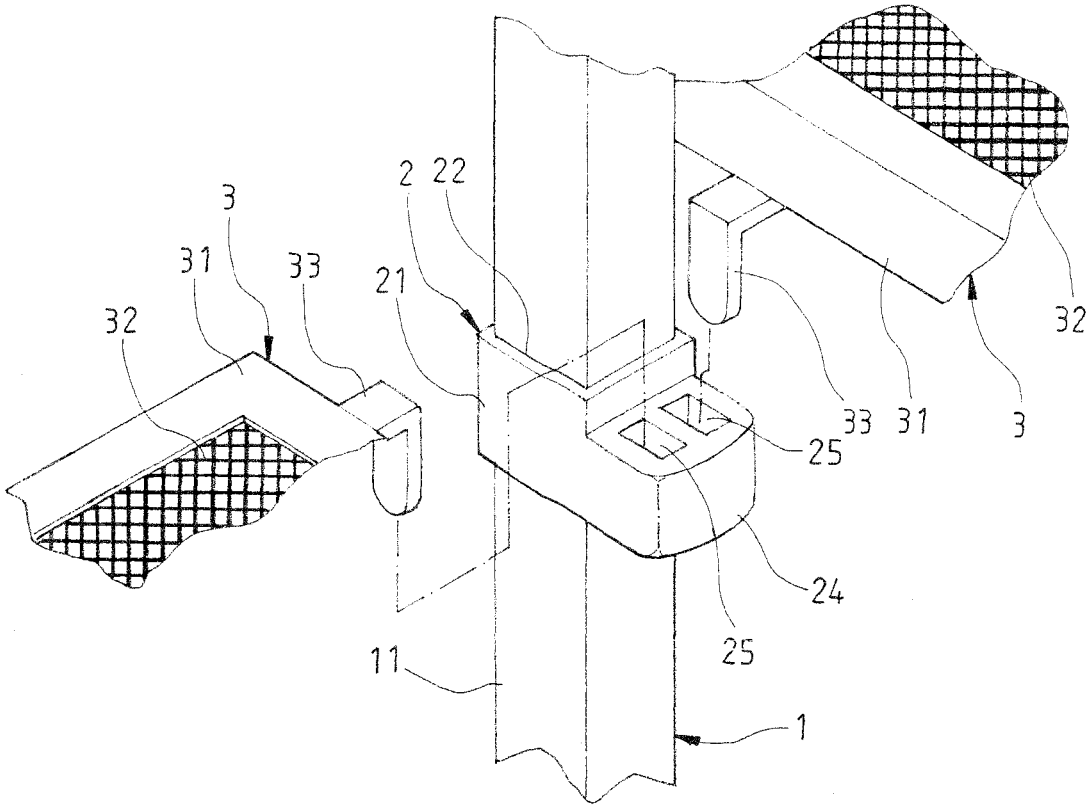
FIG. 6 is another illustration showing an embodiment assembled to be a horizontally extended combination of the shelving system of the present invention.
Figure 6:
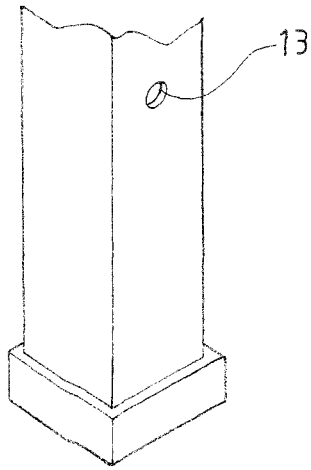

FIGS. 5 and 6 are illustrations showing the embodiment assembled to be a horizontal extension combination of the shelving system of the present invention. As shown in the figures, during the assembly of the shelving system of the present invention, the stand unit 1 can be adequately increased in number; similarly the number of mounting connectors 2 on the vertical portions 11 of the stand units 1 can too be increased. In addition, the protruding block 24 of the mounting connector 2 comprises two positioning holes 25 such that the locking pins 33 of two supporting panels 3 can be inserted into the two positioning holes 25 respectively in order to form a horizontally extended combination of the supporting panels 3.

Figure 7:
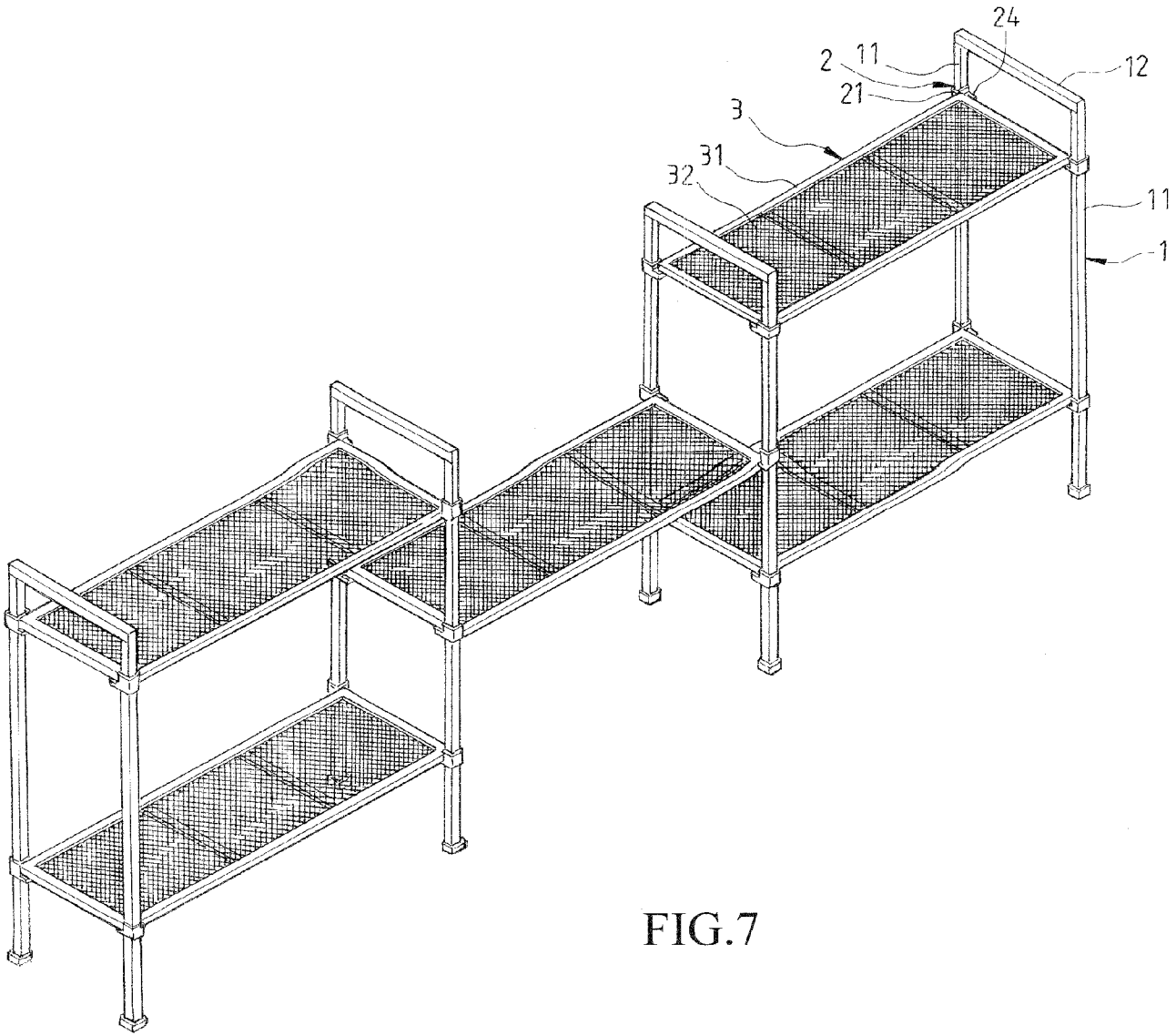
FIG. 7 is a perspective view of a complete assembly of a horizontally extended combination of the shelving system of the present invention.

FIG. 7 shows a perspective view of the complete assembly of a horizontally extended combination of the shelving system of the present invention. As shown in FIGS. 5, 6 and 7, for a horizontally extended combination of the shelving system of the present invention, the shelving system is structurally configured by assembling a plurality of stand units 1 with a plurality of mounting connectors 2 mounted thereon such that an adequate number of support panels can be arranged vertically and can be extended horizontally in combination via the insertion of the locking pins 33 thereof into the positioning holes 25 of the mounting connectors 2. With such novel and improved structural configurations of the shelving system of the present invention, the shelving system is configurable to be of different sizes and levels for storage and can too be easily manipulated to increase its storage capacity or space via simple and easy assembly operations.

Figure 8:
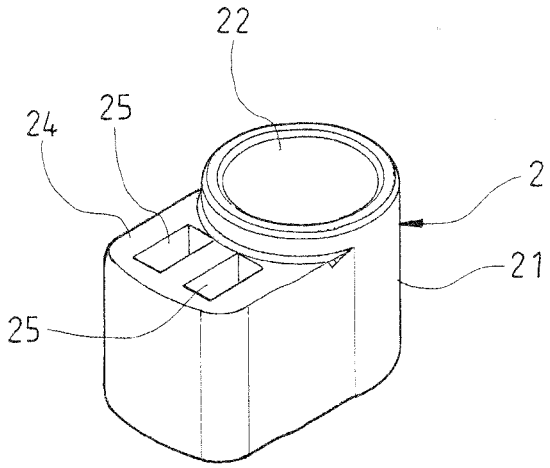
FIG. 8 is a perspective view of another embodiment of the mounting connector of the shelving system of the present invention.
Figure 9:
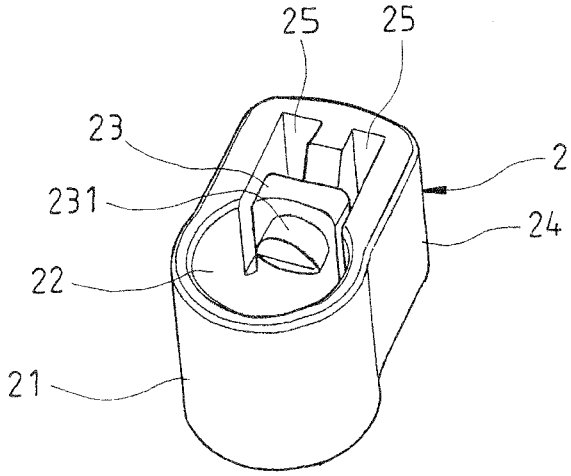
FIG. 9 is a perspective view of still another embodiment of the mounting connector of the shelving system of the present invention.

FIGS. 8 and 9 show different embodiments of the mounting connector of the shelving system of the present invention. As shown in the figures, the mounting connector 2 of the shelving system of the present invention can of different shapes other than the rectangular shape mentioned in the previous embodiment of the present invention. In another embodiment, the main body 21 can be of a round shape, and similarly, the main body 21 also comprises a through hole 22 and an elastic securement hook 23 as well as a horizontally extended protruding block 24; wherein the protruding block 24, similarly, comprises positioning holes 25 arranged parallel to each other.

Figure 10:
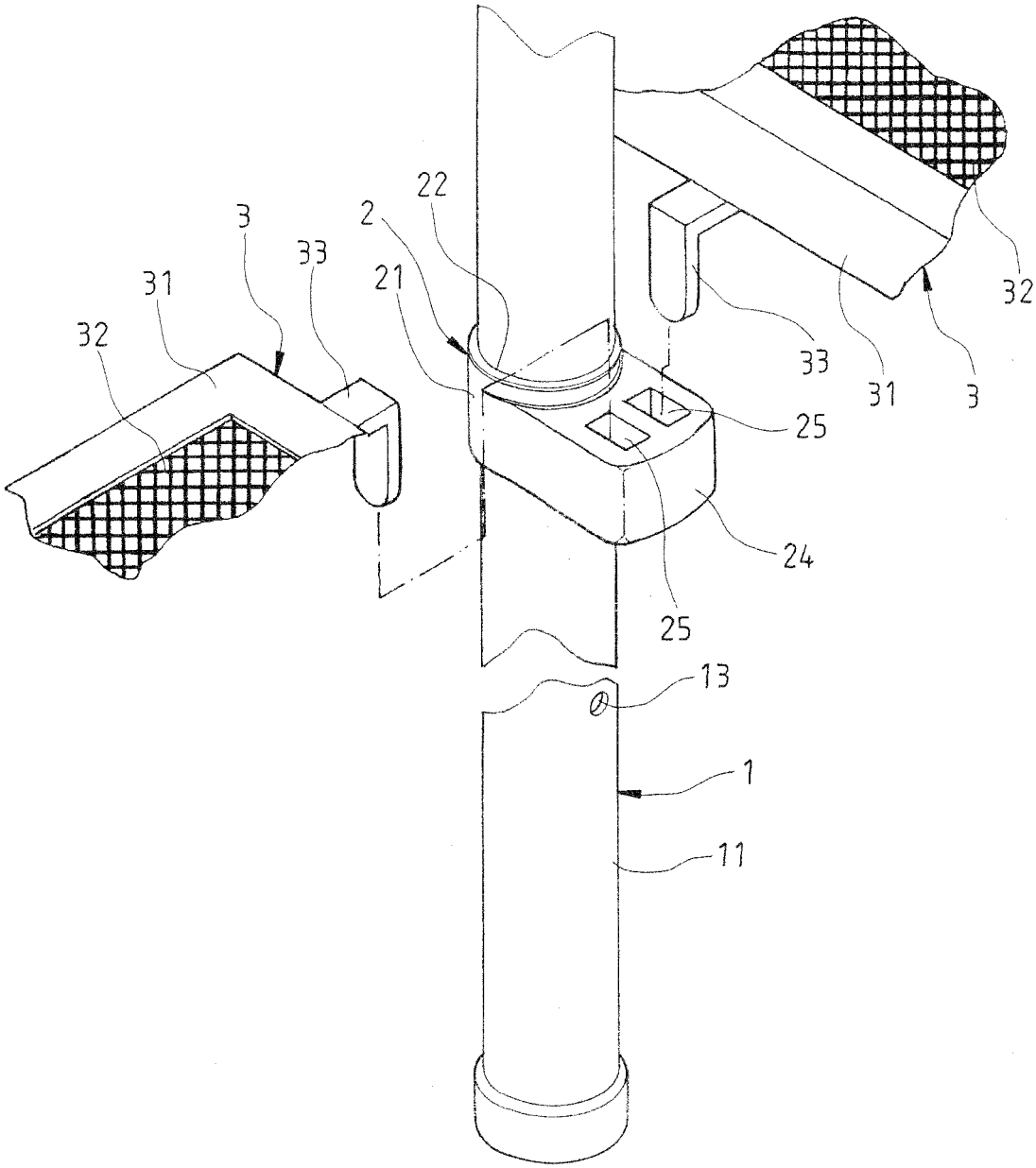
FIG. 10 is a perspective view of a second embodiment of the shelving system of the present invention.

FIG. 10 shows a second embodiment of the shelving system of the present invention. As shown in the figure, the mounting connectors 2 are of a round shape and the vertical portions 11 of the stand unit 1 are of a round tube shape. Similarly, the vertical portions 11 comprise a securement hole 13. During the assembly of the shelving system, the mounting connectors 2 penetrate through the vertical portions 11 of the stand unit 1 and mounted thereon such that the mounting connectors 2 are disposed on the two vertical portions 11 respectively, allowing the supporting panels 3 to be secured by inserting the locking pins 33 into the positioning holes 25, and such that the supporting panels can be arranged to extend in both vertical and horizontal directions. Therefore, the shelving system of the present invention can be easily manipulated to increase its storage capacity or space via simple and easy assembly operations and is also configurable to be of different sizes and levels for storage.

What is claimed is:

1. A shelving system, comprising:

at least one stand unit; at least one mounting connector and at least one supporting panel; wherein said at least one stand unit comprises two vertical portions and a horizontal portion connected to said vertical portions, and said vertical portions comprise a plurality of securement holes spaced apart from each other; wherein said at least one mounting connector comprises a main body having a through hole, and said through hole comprises an elastic securement hook, and said main body comprises a horizontally extended protruding block having positioning holes arranged parallel to and juxtaposing each other, said protruding block comprising a hollow portion formed therein, said elastic securement hook being arranged between said through hole and said hollow portion in such a way that said elastic securement hook is deflectable into the hollow portion to move out of said through hole; wherein two sides of said at least one supporting panel comprise locking pins; and wherein said at least one mounting connector is mounted to said vertical portions of said at least one stand unit by receiving one of said vertical portions therein and setting said securement hook into one of said securement holes of said one of said vertical portions to allow said locking pins of said at least one supporting panel to be inserted into said positioning holes such that assembly and disassembly of said shelving system is facilitated and such that said shelving system is configurable to be of different sizes and levels for storage.

2. The shelving system according to claim 1, wherein said plurality of securement holes of said vertical portions of said stand unit is provided on an inner edge of said vertical portions.

3. The shelving system according to claim 1, wherein said securement hook of said at least one mounting connector comprises a deflectable slat formed between said through hole and said hollow portion and a protrusion that is provided on said slat and is engageable with said securement holes of said vertical portions of said stand unit.

4. The shelving system according to claim 1, wherein said locking pins on said two sides of said at least one supporting panel are of an L shape.

5. The shelving system according to claim 1, wherein said at least one supporting panel comprises a frame body and a mesh member such that said locking pins are provided on said two sides of said frame body.

6. The shelving system according to claim 1, wherein a protrusion of said securement hook of said at least one mounting connector is configured to be tilted at an angle in order to facilitate securing said securement hook into said positioning holes of said vertical portions of said at least one stand unit.

7. The shelving system according to claim 1, wherein said positioning holes of said protruding block of said main body are rectangular-shaped holes.

* * * * *